US009555631B2

(12) United States Patent
Arthur et al.

(10) Patent No.: US 9,555,631 B2
(45) Date of Patent: Jan. 31, 2017

(54) LAMINATE MANIFOLDS FOR MESOSCALE FLUIDIC SYSTEMS

(75) Inventors: Alan R. Arthur, Salem, OR (US); Chris Aschoff, Corvallis, OR (US); Ronald A. Hellekkson, Eugene, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 1048 days.

(21) Appl. No.: 13/259,442

(22) PCT Filed: Oct. 12, 2009

(86) PCT No.: PCT/US2009/060371
§ 371 (c)(1),
(2), (4) Date: Sep. 23, 2011

(87) PCT Pub. No.: WO2011/046539
PCT Pub. Date: Apr. 21, 2011

(65) Prior Publication Data

US 2012/0019600 A1 Jan. 26, 2012

(51) Int. Cl.

| | |
|---|---|
| ***B41J 2/04*** | (2006.01) |
| ***B41J 2/16*** | (2006.01) |
| *B41J 2/14* | (2006.01) |

(52) U.S. Cl.
CPC ..... *B41J 2/1623* (2013.01); *B41J 2/14024* (2013.01); *B41J 2/16* (2013.01); *B41J 2/1631* (2013.01); *B41J 2/1632* (2013.01); *B41J 2002/14362* (2013.01); *B41J 2002/14419* (2013.01); *B41J 2202/20* (2013.01); *B41J 2202/21* (2013.01); *Y10T 137/85938* (2015.04); *Y10T 156/1056* (2015.01)

(58) Field of Classification Search
USPC ..... 347/20, 44, 47, 54, 56, 61–65, 67–68, 347/70–71, 84–86
See application file for complete search history.

(56) References Cited

U.S. PATENT DOCUMENTS

| | | | | |
|---|---|---|---|---|
| 4,883,219 | A | 11/1989 | Anderson et al. | |
| 5,489,930 | A | 2/1996 | Anderson | |
| 5,907,338 | A | 5/1999 | Burr et al. | |
| 6,074,204 | A | 6/2000 | Audebert et al. | |
| 6,435,653 | B1 | 8/2002 | Boyd et al. | |
| 6,789,884 | B2 * | 9/2004 | Debesis et al. | 347/85 |
| 6,796,731 | B2 | 9/2004 | Silverbrook | |

(Continued)

FOREIGN PATENT DOCUMENTS

| | | |
|---|---|---|
| JP | 1998-166581 | 6/1998 |
| JP | 2005-500926 | 3/2003 |

(Continued)

*Primary Examiner* — Juanita D Jackson
(74) *Attorney, Agent, or Firm* — HP Inc—Patent Department

(57) ABSTRACT

Laminate manifolds, and their manufacture. The laminate manifolds (18) include plates (20) arranged in parallel, forming a laminate plate stack (22), with a securing agent (24) securing the plates in the plate stack. At least some of the plates incorporate apertures (26) that are oriented in their respective plates so that when the plates are arranged in the laminate plate stack (22), the apertures define a fluidic pathway (28) that emerges from the laminate plate stack between parallel plates. The laminate manifolds are particularly useful as ink manifolds (14) for inkjet printers (10).

20 Claims, 6 Drawing Sheets

(56) References Cited

U.S. PATENT DOCUMENTS

| | | | |
|---|---|---|---|
| 7,192,125 | B2 | 3/2007 | Silverbrook |
| 7,198,360 | B2 | 4/2007 | Watanabe et al. |
| 7,213,989 | B2 | 5/2007 | Silverbrook |
| 7,347,533 | B2 | 3/2008 | Elrod et al. |
| 7,556,360 | B2 | 7/2009 | Silverbrook et al. |
| 2004/0080588 | A1 | 4/2004 | Silverbrook et al. |
| 2004/0130594 | A1 | 7/2004 | Watanabe et al. |
| 2007/0195115 | A1 | 8/2007 | Silverbrook |
| 2008/0180492 | A1 | 7/2008 | Ito |
| 2008/0303877 | A1 | 12/2008 | Hara |

FOREIGN PATENT DOCUMENTS

| | | |
|---|---|---|
| JP | 2006-130917 | 5/2006 |
| JP | 2007062082 | 3/2007 |
| JP | 2008-183804 | 8/2008 |

* cited by examiner

LAMINATE MANIFOLDS FOR MESOSCALE FLUIDIC SYSTEMS

BACKGROUND

Advances in photolithographic techniques and other fabricating methods have permitted the manufacture of very small scale fluidic mechanisms on silicon chips. Perhaps the best-known example is the inkjet printhead die, which has revolutionized desktop publishing by permitting the manufacture of desktop printers that can produce documents with both a high level of detail, and precise control of color.

Unfortunately, as printheads are manufactured to ever smaller dimensions and closer tolerances, the ink delivery system must still deliver fluid consistently and cleanly from the ink supply (a macrosopic fluidic system) to the printhead die (a microscopic fluidic system).

Although manifold structures may be prepared using low cost molded plastic, such molded manifold structures typically cannot attain the geometries required by printhead dies with ever-decreasing feature sizes. This is particularly true as the overall size of the manifold parts increase for supplying ink to large printhead arrays. Molded plastic parts also do not lend themselves readily to secondary machining operations for improved flatness. Although parts may be prepared via die casting or other molding processes, the resulting manifold structures similarly have difficulty in creating sufficiently small geometries or the kinds of feature sizes required for larger parts.

The use of photolithography or laser etching may produce very fine feature structure, but such fabrication methods may be prohibitively expensive. While they may reach the required dimensions, fabrication methods are typically too costly either due to the materials used, the processing time, the capital investment required, or some combination of the three.

DETAILED DESCRIPTION

A fluidic manifold having a desired orientation and/or geometry is often required for a particular application where conventional molding and casting techniques are not capable of reproducing the desired features. By constructing a laminate manifold, as described herein, the desired orientation and/or geometry may be readily prepared at low cost, particularly for small-scale manifolds, such as where the manifold must provide a transition from a scale on the order of millimeters to a scale on the order of microns (microscale). By largely decoupling the geometry of the microscale interface from the fabrication technique, and the use of laminates of desired thicknesses, the use of a laminate fluidic manifold permits fluidic feed geometries that are not readily achieved in plastic or via die cast molding methods. In particular, by utilizing the thickness of the laminate used to determine the size of the microscale interface, expensive fabrication and processing techniques typically necessary for such small features, such as laser or photolithographic fabrication, can be avoided.

The laminate manifolds described herein may be particularly useful when used as ink manifolds for inkjet printers. The laminate manifold may efficiently connect sources of ink to their respective printhead dies, even when the geometry of the printhead may occur on the micrometer scale.

Figure 1:
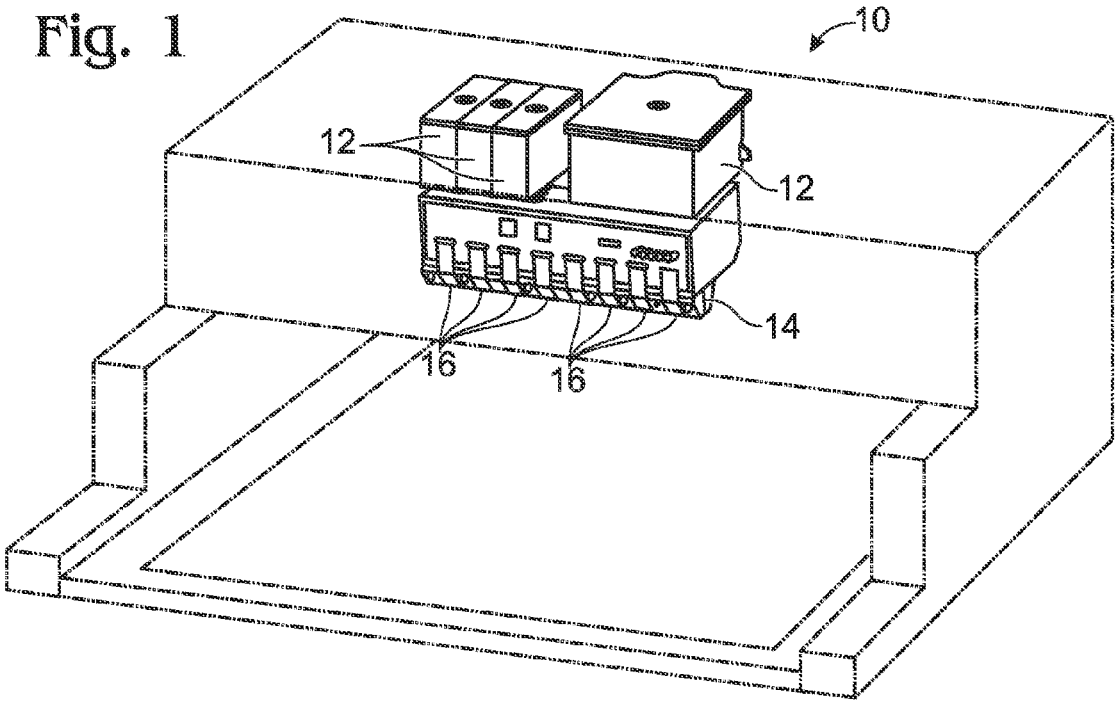
FIG. 1 is a perspective view of an inkjet printer that includes printhead assembly incorporating a laminate ink manifold, according to an embodiment of the present invention.

FIG. 1 shows an inkjet printer 10 that includes multiple ink supplies 12, a laminate ink manifold 14, and inkjet printheads 16. The laminate manifold 14 provides fluidic pathways for the ink to flow from an ink supply 12 to the corresponding inkjet printhead 16, and therefore simultaneously interfaces with a fluid interface (the ink supply, typically having a millimeter scale) and a microscale fluid interface (the printhead die).

Figure 2:
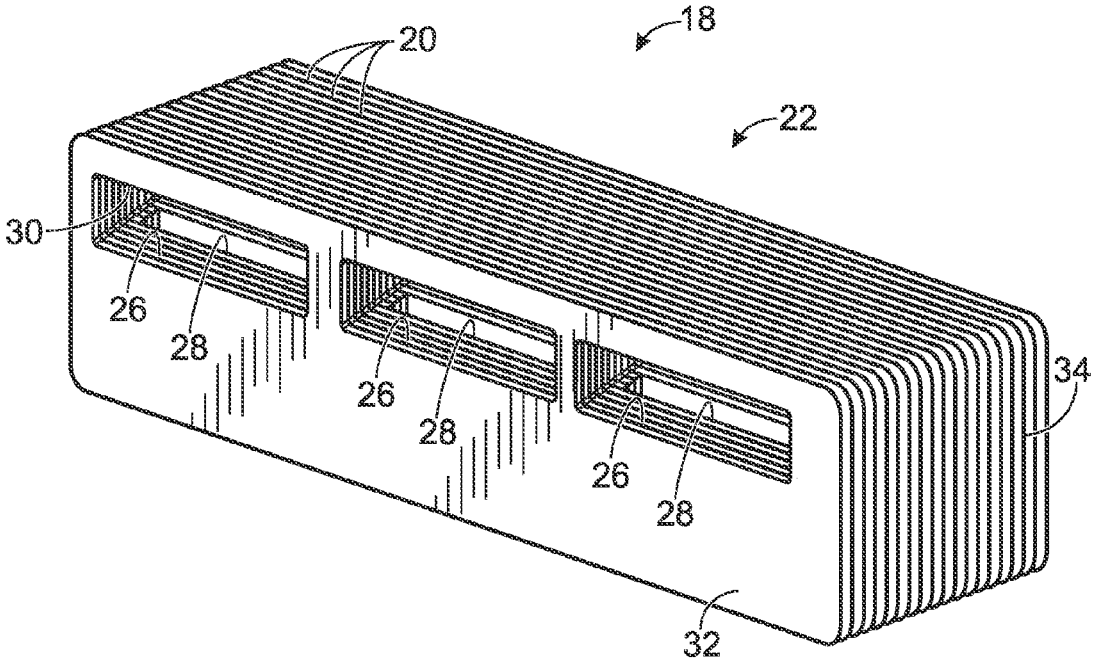
FIG. 2 is a perspective view of a laminate manifold, according to an embodiment of the present invention.

An exemplary laminate manifold 18 is shown in FIG. 2. Laminate manifold 18 includes a plurality of parallel plates 20 arranged into a plate stack 22. The individual plates 20 in the plate stack 22 are secured by a securing agent 24 (shown in FIG. 4). At least some of the plates 20 in the plate stack 22 incorporate one or more apertures 26.

The plates 20 are generally arranged in the plate stack 22 in parallel. That is, the plane of each plate is substantially parallel to the plane of each other plate. It is expected that each plate will exhibit minor deviations from being perfectly planar, and that the plane defined by each plate may deviate from being perfectly parallel to every other plate in the plate stack 22. As described herein, the plates are arranged substantially in parallel, for example within +/−10 degrees of being parallel.

An aperture, as used in reference to the laminate plates, refers to any hole, void, slit, slot, or perforation of the plate material. The aperture may have an open edge or boundary, particularly where the aperture is adjacent an edge of the plate, or extends to an edge of the plate. Where the aperture is entirely and continuously defined by plate material, it is a closed or internal aperture. The various apertures may be of any size or shape necessary to fulfill the operating requirements of the resulting laminate manifold.

Figure 3:
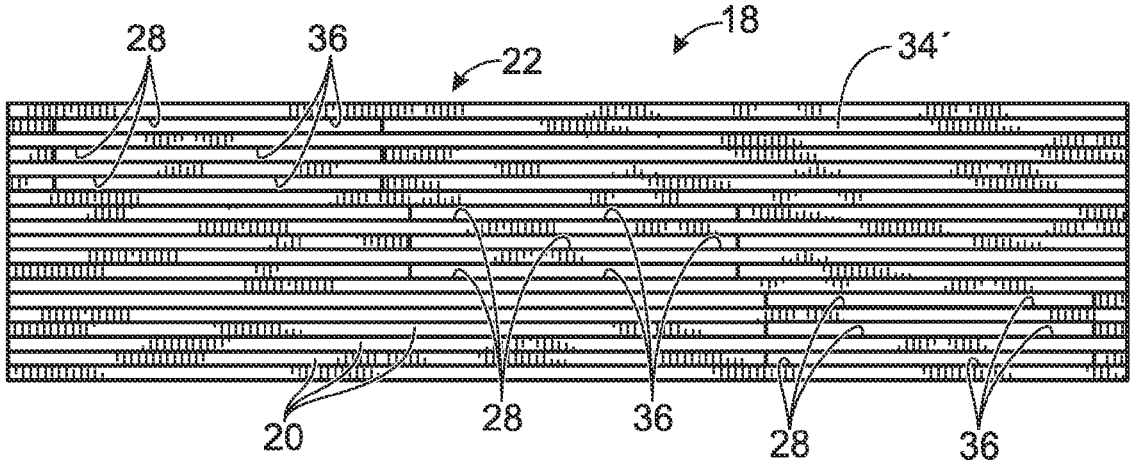
FIG. 3 is a bottom elevation view of the lower side of the laminate manifold of FIG. 2.

As shown in FIGS. 2 and 3, the individual apertures 26 in the stacked plates 20 are oriented and placed such that when the plates are placed in an ordered parallel stack 22, the apertures define at least one fluidic pathway 28 within the plate stack 22. Typically, the fluidic pathway 28 will have an origin 30 at a face 32 or side 34 of the laminate manifold 18, and a terminus 36 on a side 34' of the laminate manifold 18. Typically, the origin 30 of a fluidic pathway includes an interface at a millimeter scale while the terminus includes a microscale interface. Typically, each fluidic pathway (28) emerges from the laminate plate stack between parallel plates. That is, the terminus (36) of each fluidic pathway is at least partially defined by at least two parallel plates.

The fluidic pathway may exit the laminate manifold between two adjacent plates, if there is sufficient space between the adjacent plates. For example, where the interplate space is left empty, and not filled with an adhesive. More typically, the parallel plates that help define the fluidic pathway terminus are separated by a space corresponding to the width of one or more intervening plates, and are formed by apertures present in those intervening plates.

Where a side 34 that includes a fluidic pathway terminus is disposed at right angles to the plane of the parallel plates, the fluidic pathway emerges from the laminate plate stack in a direction substantially parallel to the plane of the parallel plates. In one aspect of the laminate manifold, the terminus 36 is disposed on a lower side of the manifold 34' and the fluidic pathway emerges from the laminate plate stack in a direction substantially parallel to the plane of the parallel plates.

Fluid may be urged along a fluidic pathway with aid of capillary forces, pressure differentials, or any other suitable motive force. When the laminate manifold is oriented substantially vertically, however, gravity may aid the flow of fluid within the fluidic pathway. Further, disruption of fluid flow by bubbles within the pathway may be minimized or avoided, as the substantially vertical orientation of the fluidic pathway in combination with its geometric profile in cross section may permit bubbles within the fluidic pathway to escape the manifold.

Figure 4:
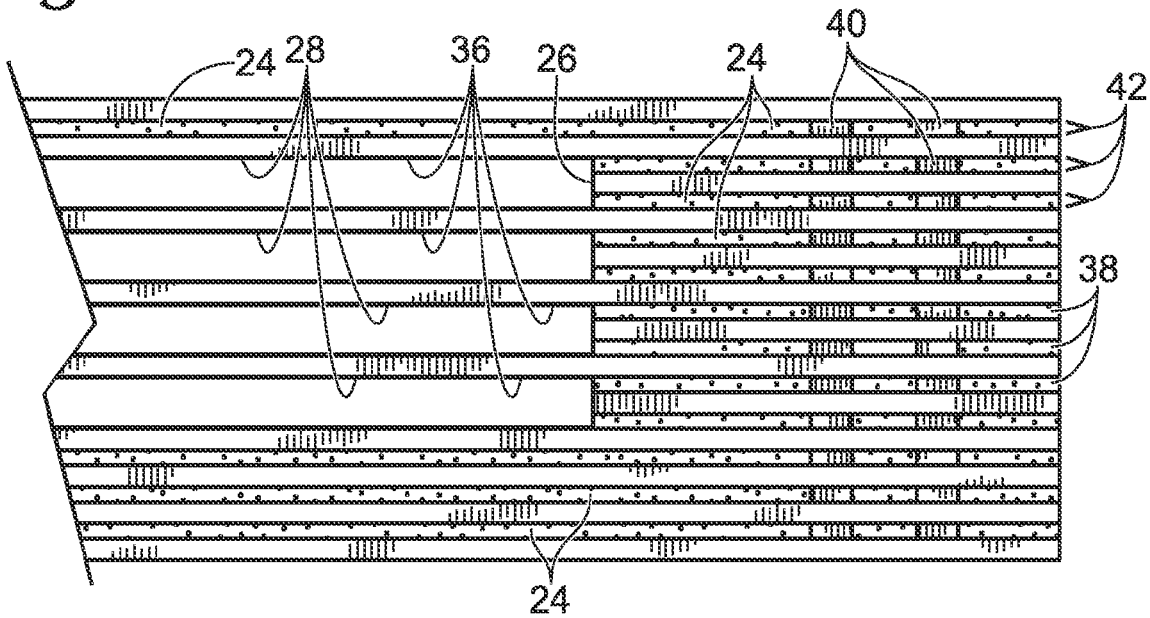
FIG. 4 is a partial bottom elevation view of a laminate manifold according to an embodiment of the present invention.

The securing agent 24 may be any agent that serves to securely bind the individual plates 20 into a unitary laminate manifold 18. The securing agent may be completely mechanical, such as a clamp, or jig assembly. Alternatively, the securing agent may be a discrete substance used to secure the plates of the laminate stack to each other. In FIG. 4, the securing agent 24 is an adhesive that fills the interplate spaces 38 within the plate stack 22. Where the securing agent is an adhesive, the adhesive may be applied as a film, via a spray application, via dipping, or any other suitable application method. In one aspect of the disclosed manifolds, the stacked plates are dipped into adhesive, and the adhesive wicks via capillary action into the interplate spaces of the plate stack. The adhesive 24 may therefore be selected to be capable of wicking into the interplate spaces completely, while not obstructing the apertures 26 present in the plates. The securing agent 24 will therefore, in combination with the plates 20 themselves, define the fluidic pathways 28 within the laminate manifold 18.

The plates of the laminate manifold may additionally feature one or more stand off features 40, as shown in FIG. 4. The stand off features are optionally formed from the material of the plates 20 themselves, and serve to create a defined and reproducible spacing 42 between the individual plates 20. Alternatively, or in addition, discrete stand off features may be added or affixed to the individual plates before they are incorporated into a laminate manifold. The stand off features 40 help create a uniform spacing 42 between the plates 20.

The laminate plates themselves may be uniform in thickness, or may vary in thickness. For example, the plates disposed between adjacent terminuses of fluidic pathways may be selected to be somewhat thinner, with respect to other plates in the laminate plate stack, in order to accommodate particularly closely spaced features on a printhead die, for example.

The plate thickness and stand off features may be selected so that the resulting laminate manifold exhibits a plate pitch geometry of between about 1060 microns to about 400 microns, or less. The terminus openings of a laminate manifold may be about 12 microns to about 1 millimeter in width.

Laminate manifolds, as disclosed herein, are generally configured to supply fluid to a mating fluidic assembly. The mating fluidic assembly may incorporate extremely small fluidic features, and so the laminate manifold must be prepared to correspond to, match with, and cross-feed to its mating fluidic assemblies. For example, the terminus opening of the fluidic pathways may be mated to a silicon die that is a component of an inkjet printer, such as an inkjet printhead. The laminate structure of the disclosed manifolds can provide terminus openings smaller than those obtainable by molding or die casting.

Manufacture of Laminate Manifolds

Figure 5:
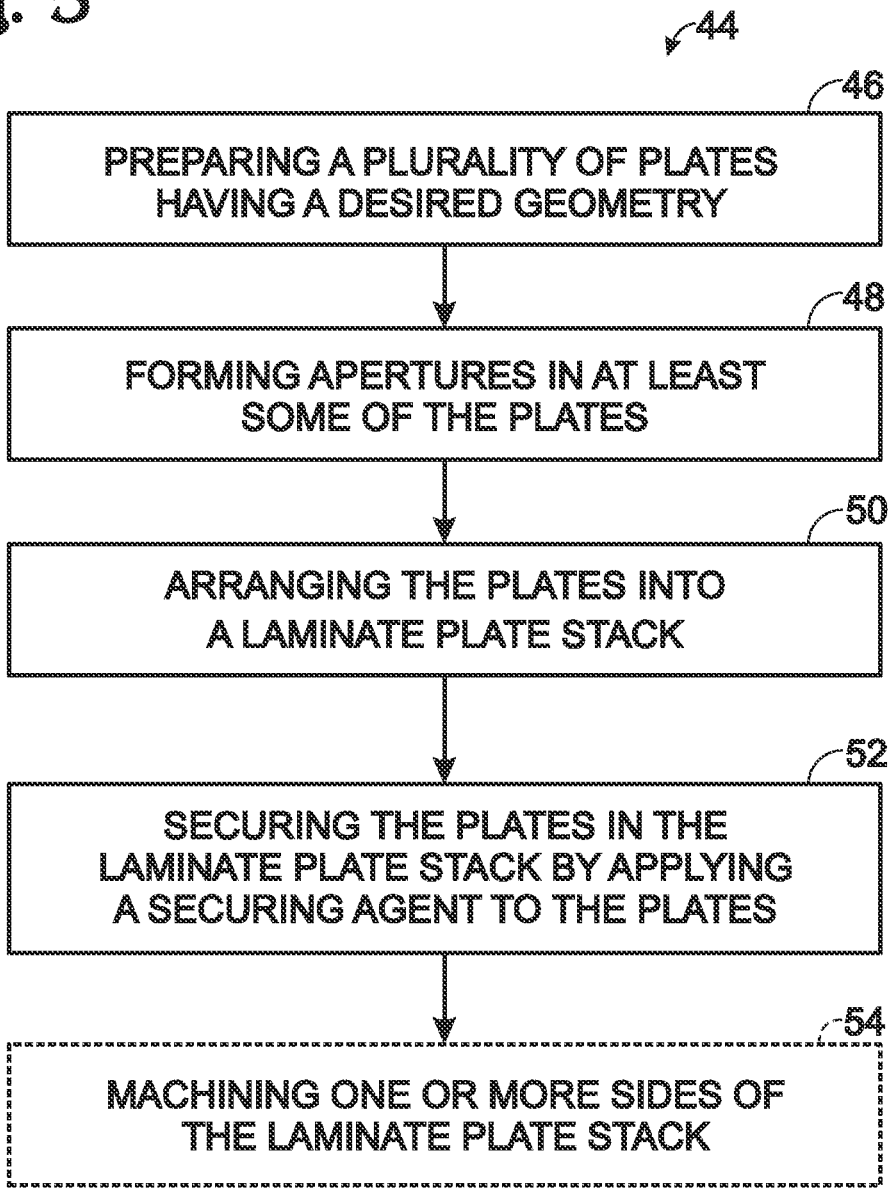
FIG. 5 is a flowchart setting forth a method of manufacturing a laminate manifold according to an embodiment of the invention.

A representative method of manufacture of the laminate manifolds described herein is set out in FIG. 5, at 44, and includes preparing a plurality of plates having a desired geometry at 46, forming apertures in at least some of the plates at 48, arranging the plates into a laminate plate stack at 50, and securing the plates in the laminate plate stack by applying a securing agent to the prepared plates at 52, so that the apertures in the plates define at least one fluidic pathway within the laminate plate stack that emerges from the laminate plate stack between parallel plates. This method of manufacture may further include machining one or more sides of the laminate plate stack 54. Furthermore, the step of forming apertures in the prepared plates may include forming standoffs in the plates, either simultaneously or sequentially.

Figure 6:
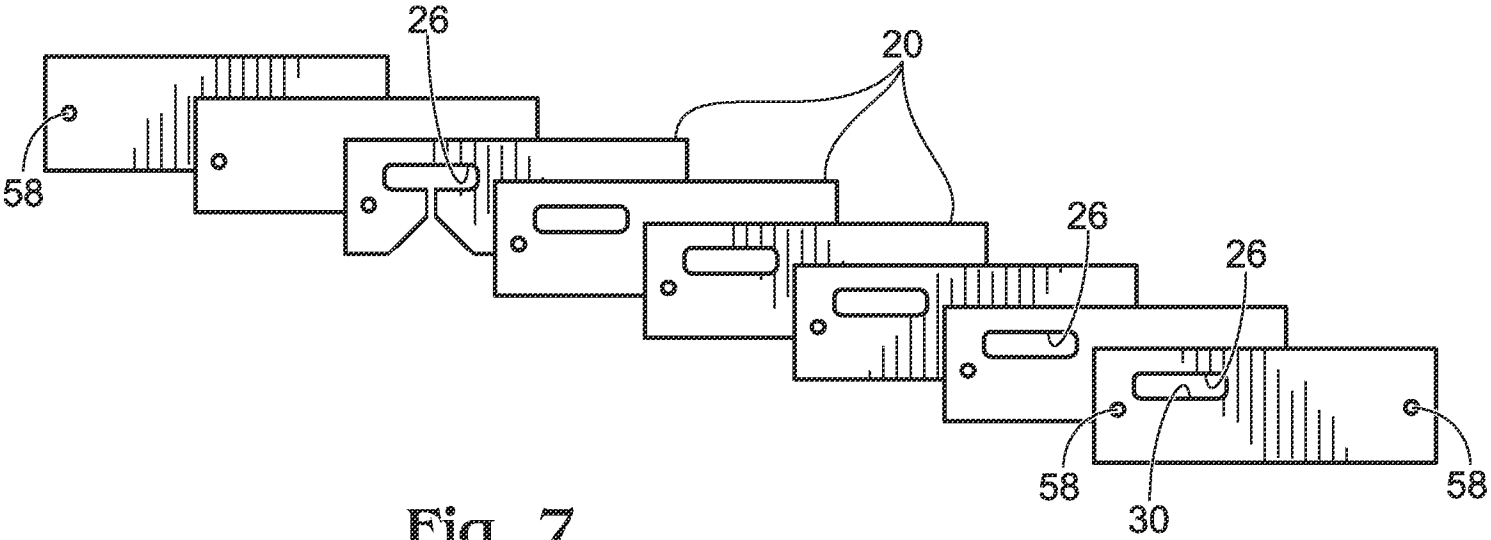
FIG. 6 depicts a simplified array of plates incorporating apertures configured to create a laminate manifold when stacked and secured, according to an embodiment of the present invention.
Figure 7:
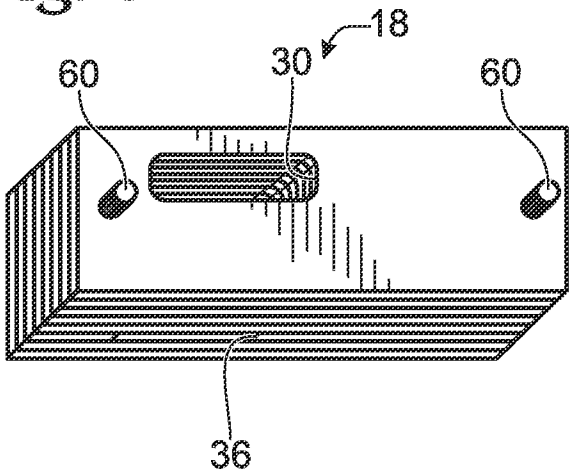
FIG. 7 is a perspective view of the simplified laminate manifold resulting from the stacking and securing of the plates of FIG. 6, including the lower side of the simplified laminate manifold.

In a simplified schematic view, the correspondence between the apertures defined by the individual plates of the plate stack and the resulting fluidic pathways of the laminate manifold is shown in FIGS. 6 and 7. FIG. 6 depicts a simple array of prepared plates 20, including apertures 26, while FIG. 7 depicts the completed laminate manifold formed by the plates of FIG. 6, showing the single fluidic pathway origin 30 and terminus 36.

FIG. 6 also depicts locational features to aid in assembly. Locating holes 58 may also be formed via progressive die stamping and are configured in size and location to mate with a corresponding alignment feature, such as pin 60, to properly orient the plates and help secure them in a stack.

Any material that can be machined, molded or otherwise fabricated into a plate having the requisite apertures and thickness can be used in preparing the laminate manifolds described herein. Laminate plates may be prepared from materials with high temperature capabilities (such as metals, ceramics, glass, and the like), or lower temperature materials such as polymers. By selecting the thermal properties of the laminate material carefully, a manifold may be prepared that closely matches the coefficient of thermal expansion (CTE) and/or the stiffness of a silicon printhead die. Each class of material has certain advantages, but they may require different securing agents or methods when preparing the laminate manifold. In one aspect of the disclosed manifold, the laminate plates are prepared from stainless steel, glass, ceramic, or polymeric materials.

A plate prepared from a material that is chemically resistant may be used so as to confer chemical resistance onto the resulting manifold. For example, such plates may be prepared from chemically resistant stainless steel, such as SS 316L. Alternatively, the material may be selected to exhibit a selected coefficient of thermal expansion (CTE), in order to match the CTE of a mating fluidic assembly. For example, where the mating fluidic assembly is a silicon die, the plates may be prepared from an alloy such as KOVAR (a nickel-cobalt ferrous alloy), or INVAR (a nickel steel alloy), silicon carbides, or silicon nitrides.

The apertures may be formed in the plates by any method that is compatible with the material of the plates and that is capable of forming apertures of the desired dimensions, such as photolithography, milling, punching, and/or molding. In one aspect of the method, the desired apertures are formed in selected metal plates using mechanical stamping. In particular, progressive die stamping may offer a low cost manufacturing method that is economical in direct material costs and in combination with the stacking laminate design permits the formation of apertures, and optionally stand off features, having the necessary fine structure for preparation of the described fluidic manifolds. The resulting manifolds may be used to achieve printhead ink manifolds of any desired size and scale. Furthermore, a rigid manifold structure may permit the manufacture of print bars that are better adapted to withstand the loads and stresses typically involved in capping and servicing of the print bar.

The plates are secured in the laminate plate stack by applying a securing agent to the prepared plates. Any securing agent capable of bonding the individual plates into a unitary laminate manifold is a suitable securing agent. The securing agent may include chemical means, such as adhesives or other substances, or physical treatments, such as the application of heat and/or pressure. The plates are optionally secured by way of brazing, soldering, or diffusion bonding. Alternatively, or in addition, the plates may be secured by a physical means, such as brackets, mountings, or fasteners. The plates may be arranged into a stack before securing, or the securing agent may be applied to the plates prior to arranging them into the desired stack, or even prior to forming apertures in the plates. The securing agent may act essentially instantaneously, or be activated by the application of thermal energy or alternative activating agent. In one aspect of the manufacture, a securing agent is applied to a first face of the laminate plates, while an activating agent for the selected securing agent is applied to the opposite face, such that upon contact with an adjacent plate, the securing agent becomes activated, securing the laminate plates. The selection of securing agent may vary depending on the chosen composition of the laminate plates.

While any suitable securing agent may be used to secure the plates into a single laminate manifold, it may be particularly advantageous to form the laminate manifold by partial or complete immersion of the plate stack into an adhesive bath, where the adhesive is selected to be capable of wicking into the interplate spaces of the plate. Once the adhesive has fully penetrated the plate stack assembly, the assembly may be removed from the adhesive, any excess adhesive may be removed and the adhesive may be cured.

Once formed and secured, the present laminate plate stacks may also be further machined, if necessary. For example, one or more sides of a rigid laminate plate stack may be machined to a degree of flatness that is not possible using conventional molded plastic manifold structures. The use of polymeric plates may result in laminate plate stacks having sides that may be machined or otherwise formed with an advantageous degree of flatness, but a greater precision may be obtained using more rigid plate materials, such as metal or ceramic materials. With further respect to printer manufacture, a greater degree of flatness may further enable a reduction in silicon die size. As the areas of contact between the silicon die and the side of the laminate manifold become more perfectly flat, the tendency of occlusions resulting from securing the die with a bonding agent to the manifold structure to block one or more fluidic pathways is reduced.

A variety of fabrication methods may be used to prepare the disclosed laminate manifold structures, employing a variety of materials and manufacturing techniques. The following example is intended to serve as a representative method.

Exemplary Manufacture of Laminate Fluidic Manifold

Using pre-sized stainless steel sheets having the appropriate thickness, a series of plates having the desired feed geometry and size and number of apertures are formed using a progressive die set. Stainless steel plates useful for manufacture of the laminate manifold may be as thin as about 12 microns. During the punching operation any desired stand off features are also formed in the plate using, for example, partial die cuts or other suitable method. Any locational features to aid in assembly may also formed via progressive die stamping. The locational features may be configured to mate with a corresponding alignment feature that is optionally incorporated into an assembly jig.

After fabrication of the individual plates is complete, the plates are cleaned to ensure that no fabrication oils or other contaminates exist on the plate surfaces. The plates may be further treated, if desired, to promote wetting and adhesion, such as by oxygen plasma treatment, nitric acid treatment, or similar activating treatment.

The fabricated plates are then stacked in the appropriate sequence in a jig. Alignment of the plates may be accomplished by simply accurately stacking the plates (relying on overall dimensions of the plates) or by one or more alignment features that mate with locational features formed in the plates. For example, the formation of two apertures in each plate configured to align with two alignment pins in the jig could be used to accurately align the plate stack, but a variety of additional alignment aids may be similarly envisioned.

When all the plates are suitably stacked and in alignment, the entire plate stack is temporarily clamped or otherwise secured. While held in the proper alignment, the plate stack may be permanently bonded together into a single laminate manifold. As discussed above, a variety of methods may be used to secure the plate stack, from diffusion bonding and microwelding to the application of a suitable adhesive material either before or after the plates are arranged into the desired stack. In this instance, the laminate manifold is secured by partial or complete immersion of the plate stack into an adhesive bath, such that the adhesive wicks into the interplate spaces of the plate. Once the adhesive has fully penetrated the plate stack assembly, the assembly is removed from the adhesive, any excess adhesive is removed and the adhesive is cured.

The type of curing action will depend on the type of adhesive used. In the case of a thermal adhesive, the adhesive may be cured by placing the plate stack assembly into an oven and heating it to the necessary temperature for curing to take place. Any other type of curing may be used, provided it is compatible with the plate stack assembly. For example, in order to prevent undesired migration of adhesive on or in the plate stack during a thermal curing step, the adhesive may be formulated to be a dual cure formulation, with an initial cure via UV exposure to stabilize the adhesive, followed by a thermal cure to fix the adhesive permanently.

Once the adhesive is set, the laminate manifold may be machined further, if needed and/or desired. For the sake of simplicity, the laminate manifold may be retained in the securing mechanism during machining, in order to increase the security of the laminate manifold, and enhance the ease of handling. For example, where the laminate manifold is secured in a jig, the laminate manifold may remain in the jig while one or more sides of the laminate manifold is machined flat.

While machining one or more sides of the laminate manifold may facilitate coupling to either a mesoscale or microscale fluidic feature, it should be appreciated that the laminate manifold may be machined in any way that is advantageous for the application it is intended for. For example, a side of the laminate manifold may be machined to a slight angle, or with a concavity or convexity. The present disclosure should not be intended to limit such further modification of the laminate manifold.

Once the desired machining is complete, the laminate manifold may be removed from the securing mechanism, and cleaned. The manifold may be cleaned ultrasonically, by immersion in a compatible solvent, or by any other suitable method. The completed laminate manifold may then be incorporated into a desired mechanism, such as an inkjet printer or other microfluidic apparatus.

Figure 8:
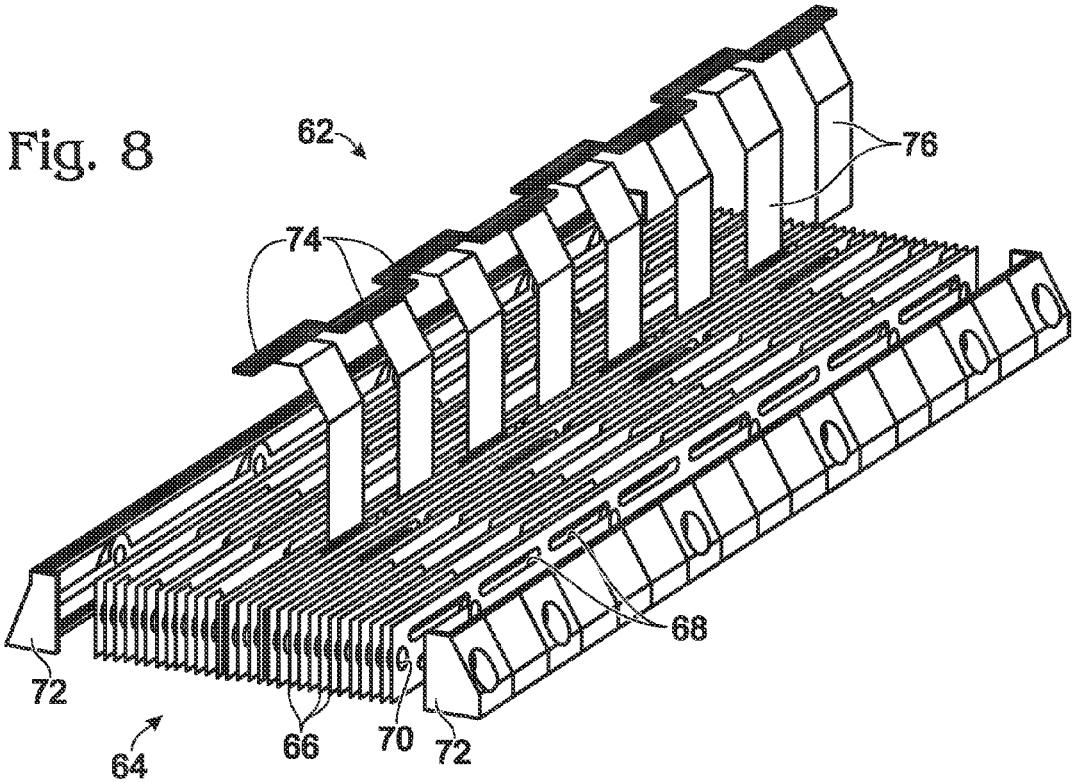
FIG. 8 is an exploded perspective view of a printhead assembly incorporating a laminate manifold according to an embodiment of the present invention.

An exemplary printhead assembly 62 incorporating a laminate manifold 64 is depicted in exploded view in FIG. 8. Printhead assembly 62 is oriented in FIG. 8 so that the silicon dies of the printhead assembly are facing upwards, in order to more clearly show selected details of the assembly. In operation, however, the printhead assembly typically would be oriented with the silicon dies directed towards the media, which is generally downwards. Laminate plates 66 are aligned in the desired order and orientation, and incorporate the appropriate apertures 68 to form the desired fluidic pathways, as well as apertures configured to be locational features 70. The laminate manifold 64 is bracketed by and coupled to a laminate manifold mounting 72 that incorporates the interface between the individual ink supplies and the origins of the fluidic pathways defined by the laminate manifold for each type of ink.

Also shown in FIG. 8 are silicon dies 74 affixed to the laminate manifold 64. Silicon dies 74 are bound to the laminate manifold in such a manner as to form the necessary interface between the terminuses of the fluidic pathways defined by the laminate manifold and the fluidic features of the silicon die itself. The silicon dies are shown coupled to flexible circuits 76, permitting a printhead controller to have an electronic connection to the silicon dies.

Figure 9:
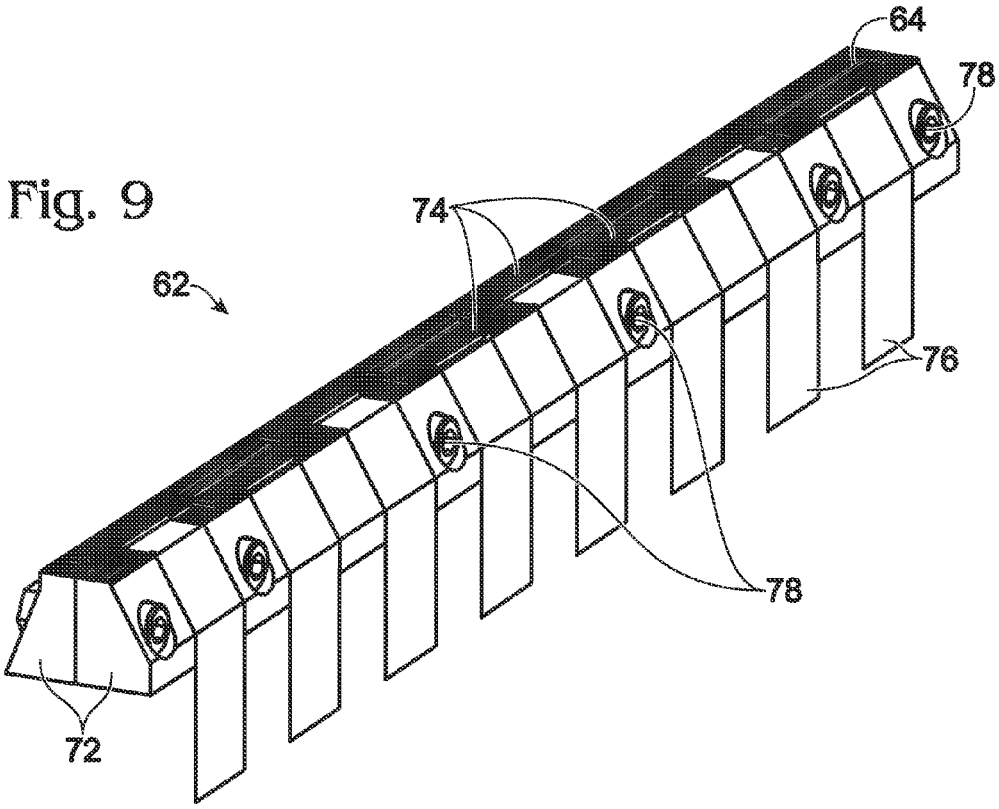
FIG. 9 is the printhead assembly of FIG. 8 depicted fully assembled.
Figure 10:
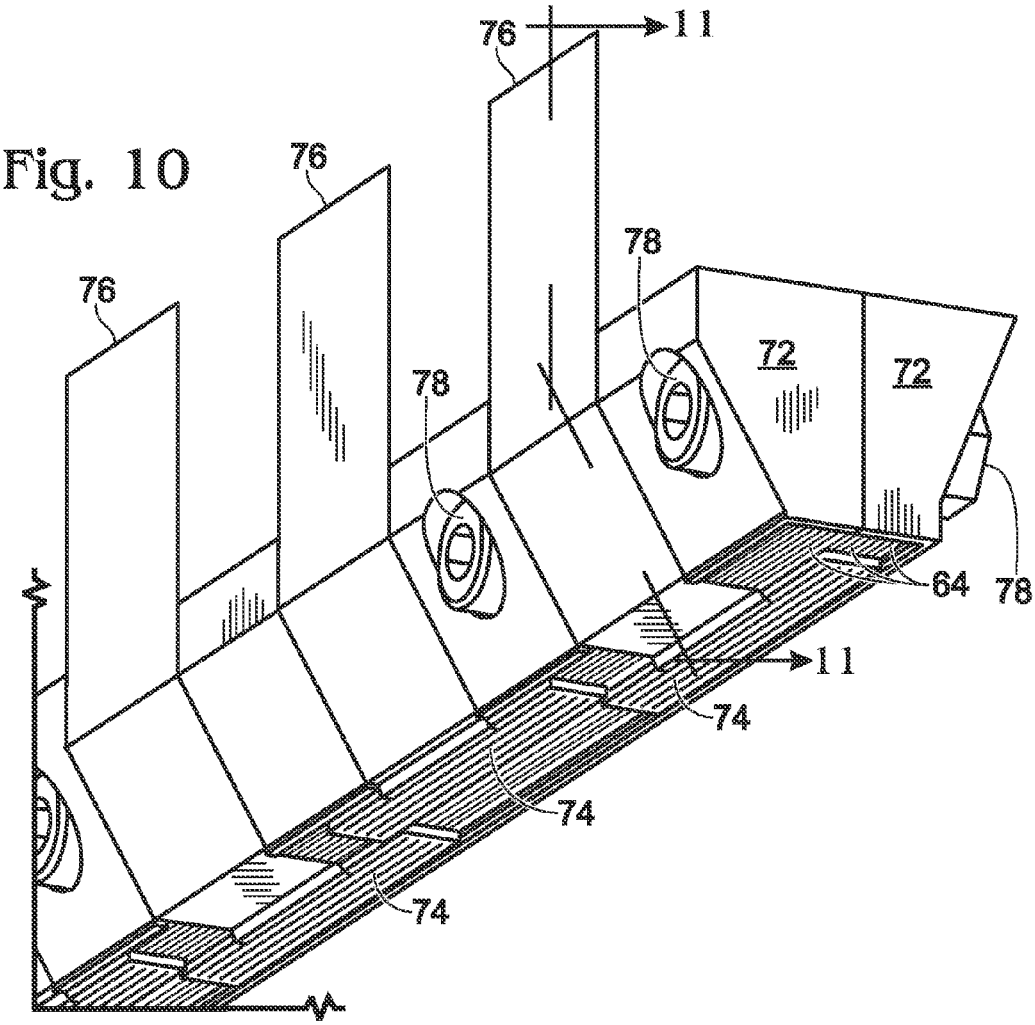
FIG. 10 is a partial magnified view of the printhead assembly of FIG. 9.

FIG. 9 shows the printhead assembly 62 of FIG. 8 in a corresponding non-exploded view. The printhead assembly is again oriented with the silicon dies facing upwards for the sake of clarity. In FIG. 9 the laminate manifold is secured within the laminate manifold mount 72 at least partially by fasteners 78. FIG. 10 depicts a portion of the printhead assembly 62 in its operational orientation, with silicon dies 74 directed downward.

Figure 11:
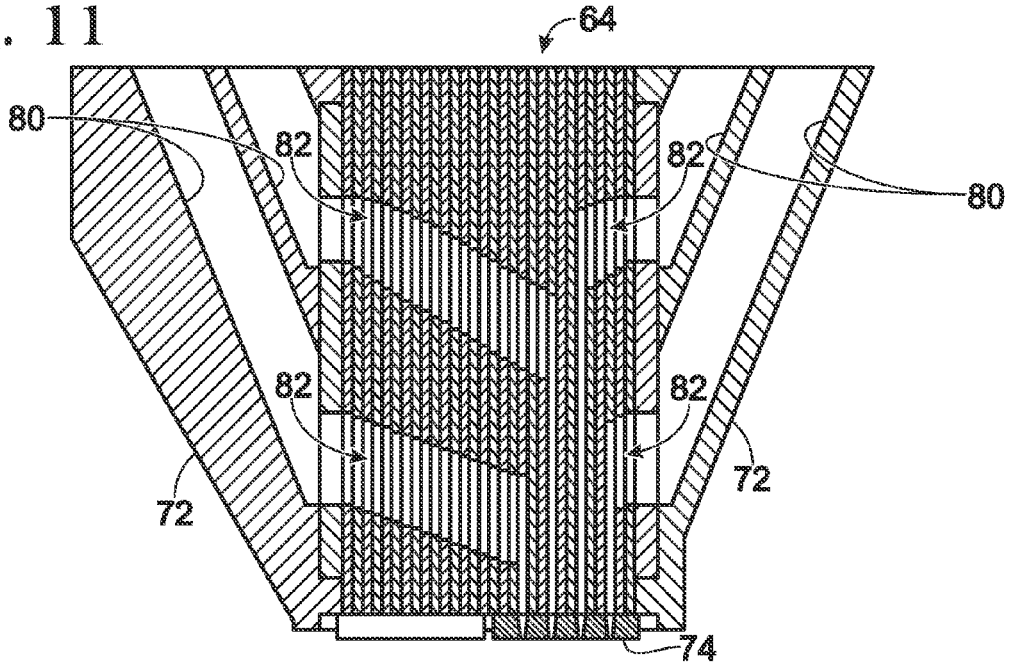
FIG. 11 is a cross section view of the printhead assembly of FIG. 9.

FIG. 11 is a cross section of the printhead assembly of FIG. 9, in particular showing the ink supply conduits 80 within the laminate manifold mount and their interface with the fluidic pathways 82 of the laminate manifold 66.

Advantages of the Disclosed Laminate Manifolds

The laminate fluidic manifolds disclosed herein possess substantial advantages over previous types of manifold structures. Where the laminate manifold plates are prepared using progressive die stamping, the overall cost becomes competitive with the use of plastic manifolds, while enabling much finer features, and tighter slot pitch feeds for the purposes of printing. Where the laminate manifolds may be prepared from metals or ceramics, they may demonstrate structural stability and stiffness, particularly when prepared from stainless steel. In comparison with an injection molded manifold prepared from LCP (liquid crystal polymer) or other plastic, a stainless steel laminate manifold with the same geometry exhibits substantially less deflection than that observed for a plastic manifold when placed under the same load. The additional stiffness for a comparable cross section attained with the disclosed laminate manifolds permit the manufacture of longer print bar spans for a given deflection, and therefore enable larger print bar lengths for large scale printers.

The size of the fluidic pathways defined by the laminate manifold, particularly the terminus of each fluidic pathway, is at least partially determined by the thickness of the plates used to assemble the manifold, and the securing agent used to bond the plates into a single laminate assembly. Through appropriate selection of plate material and securing agent, a slot pitch geometry in the range of less than 1 millimeter is achievable. This fine spacing permits a similarly small scale when fabricating a corresponding silicon die for use in manufacturing a printhead for inkjet printing. The potential reduction in the use of silicon creates a significant cost savings for the fabrication of the print system overall.

By using the laminate fluid manifolds disclosed herein, millimeter scale to microscale fluidic systems may be readily coupled in a cost efficient manner, and without the need for costly photolithographic processes or expensive materials.

What is claimed is:

1. A laminate manifold, comprising:

a plurality of parallel plates arranged in a laminate plate stack; and a securing agent securing the plates in the laminate plate stack;

where at least some of the plates incorporate one or more apertures that are oriented in their respective plates so that when the plates are arranged as a laminate plate stack the apertures define at least one fluidic pathway;

where the fluidic pathway emerges from the laminate plate stack between parallel plates.

2. The laminate manifold of claim 1, where the fluidic pathway emerges from the laminate plate stack in a direction parallel to the plane of the parallel plates.

3. The laminate manifold of claim 1, where the laminate plate stack defines a plurality of discrete fluidic pathways, each fluidic pathway having an origin at a face of the laminate plate stack and terminus that is at least partially defined by at least two parallel plates.

4. The laminate manifold of claim 1, where the securing agent is an adhesive.

5. The laminate manifold of claim 1, where the parallel plates further include one or more stand off features configured to maintain a predetermined interplate spacing.

6. The laminate manifold of claim 3, where each fluidic pathway terminus has a width of about 12 microns to about 1 millimeter.

7. The laminate manifold of claim 1, where the parallel plates are stainless steel, glass, ceramic, or polymeric materials.

8. The laminate manifold of claim 3, where the origin of each fluidic pathway is coupled to a source of fluid.

9. The laminate manifold of claim 3, where the origin of each fluidic pathway is coupled directly or indirectly to a supply of fluid ink, and the terminus of each fluidic pathway is coupled directly or indirectly to a printhead die.

10. The laminate manifold of claim 1, wherein the laminate plate stack has a first end most parallel plate having a first plate face forming a first face of the laminate plate stack, a second end most parallel plate having a second plate face forming a second face of the laminate plate stack opposite the first face of the laminate plate stack and side edges between the first end most parallel plate and the second end most parallel plate and wherein the fluidic pathway has a terminus through one of the side edges.

11. The laminate manifold of claim 1, wherein the plurality of parallel plates comprises a first parallel plate having a first plate face, a second parallel plate having a second plate face facing the first plate face and a third parallel plate sandwiched between the first parallel plate and the second parallel plate and wherein the fluidic pathway emerges from the laminate plate stack at a terminus having a dimension defined by a spacing between the first plate face and the second plate face.

12. The laminate manifold of claim 1, wherein the plurality of parallel plates comprises:

a first parallel plate having a first aperture forming a first portion of the fluidic pathway;

a second parallel plate; and a third parallel plate between the first parallel plate and the second parallel plate, the third parallel plate having a second aperture at least partially overlapping the first aperture and extending through an edge of the third parallel plate.

13. The laminate manifold of claim 12, wherein the second parallel plate blocks the fluidic passage such that the fluidic passage does not extend through the second parallel plate.

14. The laminate manifold of claim 12, wherein the second aperture has a first portion overlapping the first aperture, a second portion opening along the edge and a third portion connecting the first portion and the second portion, the third portion being narrower than the first portion and the second portion.

15. A method of manufacturing a laminate manifold, comprising:

a) preparing a plurality of plates having a desired geometry (46);

b) forming apertures in at least some of the plates (48);

c) arranging the plates into a laminate plate stack (50); and d) securing the plates in the laminate plate stack by applying a securing agent to the plates (52);

where the apertures in the respective plates are oriented to define, when arranged in the laminate plate stack, at least one fluidic pathway within the laminate plate stack that emerges from the laminate plate stack between parallel plates.

16. The method of claim 15, where securing the plates includes wicking an adhesive between non-perforated regions of the plates, and curing the adhesive within the laminate plate stack.

17. The method of claim 15, where arranging (50) the prepared plates into a laminate plate stack results in the apertures defining a plurality of fluidic pathways, each fluidic pathway having an origin at a face of the laminate plate stack and a terminus that is at least partially defined by at least two parallel plates.

18. The method of claim 15, where arranging the prepared plates into a laminate plate stack results in the apertures defining a plurality of fluidic pathways, each fluidic pathway entering and emerging, respectively, between parallel plates.

19. The method of claim 15, where preparing the plurality of plates includes preparing a plurality of stainless steel plates; and where forming apertures includes forming apertures in at least some of the prepared plates using mechanical stamping.

20. An inkjet printer, comprising:

a plurality of ink reservoirs;

at least one printhead die; and at least one laminate ink manifold that includes a plurality of parallel plates arranged in a laminate plate stack, and a securing agent securing the plates in the laminate plate stack; where at least some of the plates incorporate one or more apertures that are oriented in their respective plates so that when the plates are arranged as a laminate plate stack the apertures define at least one fluidic pathway; and where each fluidic pathway has an origin that is fluidically coupled to an ink reservoir, and each fluidic pathway has a terminus that emerges from the laminate plate stack between two of the parallel plates and that is at least partially defined by at least two parallel plates, and is fluidically coupled to the printhead die;

such that ink from each ink reservoir is delivered by at least one laminate manifold to at least one printhead die.

* * * * *